US009403660B2

(12) United States Patent
Miyajima et al.

(10) Patent No.: US 9,403,660 B2
(45) Date of Patent: Aug. 2, 2016

(54) CONVEYOR BELT TAKE-UP DRUM

(71) Applicant: The Yokohama Rubber Co., LTD., Minato-ku, Tokyo (JP)

(72) Inventors: Atsushi Miyajima, Hiratsuka (JP); Hiroshi Yajima, Hiratsuka (JP)

(73) Assignee: The Yokohama Rubber Co., LTD. (JP)

( * ) Notice: Subject to any disclaimer, the term of this patent is extended or adjusted under 35 U.S.C. 154(b) by 0 days.

(21) Appl. No.: 14/383,899

(22) PCT Filed: Jan. 30, 2013

(86) PCT No.: PCT/JP2013/052047

§ 371 (c)(1),
(2) Date: Sep. 8, 2014

(87) PCT Pub. No.: WO2013/132928

PCT Pub. Date: Sep. 12, 2013

(65) Prior Publication Data

US 2015/0097069 A1 Apr. 9, 2015

(30) Foreign Application Priority Data

Mar. 8, 2012 (JP) ..... 2012-051972

(51) Int. Cl.
*B65H 75/14* (2006.01)
*B65H 75/20* (2006.01)
*B65H 75/22* (2006.01)

(52) U.S. Cl.
CPC ..... *B65H 75/20* (2013.01); *B65H 75/14* (2013.01); *B65H 75/22* (2013.01); *B65H 2701/37* (2013.01)

(58) Field of Classification Search
CPC ..... B65H 2801/93; B65H 2301/41726; B65H 2301/419225; B65H 2301/414324; B65H 75/40; B65H 2701/5152
USPC ..... 242/536, 602, 608.2, 609.1
See application file for complete search history.

(56) References Cited

U.S. PATENT DOCUMENTS 3,869,882 A * 3/1975 Miyamoto et al. ..... 68/5 C
5,242,129 A * 9/1993 Bailey ..... B65H 75/22 242/607

(Continued)

FOREIGN PATENT DOCUMENTS

JP H02-018464 2/1990
JP H07-030255 6/1995

(Continued)

OTHER PUBLICATIONS

International Search Report dated Apr. 23, 2013, 4 pages, Japan.

*Primary Examiner* — Sang Kim
(74) *Attorney, Agent, or Firm* — Thorpe North & Western

(57) ABSTRACT

A conveyor belt take-up drum includes spacers of substantially the same length as the width of a conveyor belt being taken up onto a core section are detachably provided between opposing outer ends of main radial direction members of flange sections linked to circumferential direction members on which ground-contacting sections are provided, the bending rigidity near joints between the core section and inner ends of the opposing main radial direction members is set lower than the bending rigidity of the main bodies of the main radial direction members, and the conveyor belt taken up onto the core section is sandwiched between the main radial direction members, putting the main radial direction members, the spacers, and the conveyor belt into an integrated state.

12 Claims, 6 Drawing Sheets

(56) References Cited

U.S. PATENT DOCUMENTS

| | | | | |
|---|---|---|---|---|
| 6,330,984 | B1 * | 12/2001 | Barker et al. | 242/536 |
| 6,416,013 | B1 * | 7/2002 | Benzing, II | 242/536 |
| 6,719,236 | B1 * | 4/2004 | Douglas et al. | 242/536 |

FOREIGN PATENT DOCUMENTS

| | | |
|---|---|---|
| JP | 2002-226140 | 8/2002 |
| JP | 3125159 | 8/2006 |

* cited by examiner

CONVEYOR BELT TAKE-UP DRUM

TECHNICAL FIELD

The present technology relates to a conveyor belt take-up drum, and more specifically to a conveyor belt take-up drum that offers further improved stability when a conveyor belt is being transported and allows for reductions in the load generated in radial direction members constituting flange sections and in weight.

BACKGROUND

Conveyor belts used to transport cement, coal, ore, and the like may have total lengths of several kilometers or greater. Because large amounts of labor are required to link conveyor belt sections together in such cases, the conveyors belts are made as long as possible and transported from a manufacturing plant or the like to a usage site, reducing the amount of labor needed to link the belt sections at the usage site. Various proposals have been made for the structure of a take-up drum for long conveyor belts of this sort (see, for example, Japanese Utility Model No. 3125159).

A conveyor belt take-up drum is provided with a core section around which the conveyor belt is taken up, and flange sections provided on both ends of the core section in the axial direction. The flange sections are constituted, for example, by a plurality of radial direction members extending radially outward in the radial direction from the core section, and circumferential direction members that link the outer ends of these radial direction members to form a ring. When the conveyor belt is taken up, a certain degree of clearance (for example, around 50 mm) is formed between the ends in the belt width direction and the radial direction members. As a result, the conveyor belt may shift in the belt width direction, frequently striking against the radial direction members, when the conveyor belt is being transported.

This negatively affects the stability of the take-up drum after the conveyor belt has been taken up thereupon. Moreover, an excessive load (stress) is generated at the joints between the radial direction members and the core section. Imparting the joints with a thick structure will lead to the problem of increased take-up drum weight. Increased take-up drum weight leads to increases not only in the material cost of the take-up drum, but also in transportation costs.

SUMMARY

The present technology provides a conveyor belt take-up drum that offers further improved stability when a conveyor belt is being transported and allows for reductions in the load generated in radial direction members constituting flange sections and in weight.

The conveyor belt take-up drum according to the present technology is a conveyor belt take-up drum provided with a core section and flange sections provided at both ends of the core section in the axial direction, each of the flange sections being constituted by a plurality of radial direction members radially extending outward from the core section in the radial direction and a circumferential direction member linking outer ends of the radial direction member to form a ring, the radial direction members of the respective flange sections being disposed at opposing positions, and ground-contacting sections being provided on a portion of the circumferential direction members, wherein spacers of substantially the same length as the width of the conveyor belt being taken up by the core section are detachably provided between opposing outer ends of the radial direction members linked to those circumferential direction members of the respective flange sections that are provided with ground-contacting sections, and the bending rigidity near joints between inner ends of the opposing radial direction members and the core section is set lower than the bending rigidity of main bodies of the radial direction members.

In accordance with the present technology, spacers of substantially the same length as the width of the conveyor belt being taken up by the core section are detachably provided between opposing outer ends of the radial direction members linked to those circumferential direction members of the respective flange sections that are provided with ground-contacting sections, and the bending rigidity near joints between inner ends of the opposing radial direction members and the core section is set lower than the bending rigidity of main bodies of the radial direction members, with the result that, when the opposing radial direction members are linked by the spacers, the conveyor belt taken up on the core section is sandwiched between the radial direction members, putting them into an integrated state. As a result, clearance between the ends in the belt width direction of the sandwiched conveyor belt and the radial direction members can be eliminated or minimized. This suppresses shifting in the belt width direction of the taken-up conveyor belt when being transported, allowing the stability of the take-up drum to be further improved. In addition, the load generated near the inner ends of the radial direction members making up the flange sections is reduced, allowing for reduced weight.

DETAILED DESCRIPTION

An embodiment of the conveyor belt take-up drum according to the present technology will now be described with reference to the drawings.

Figure 1:
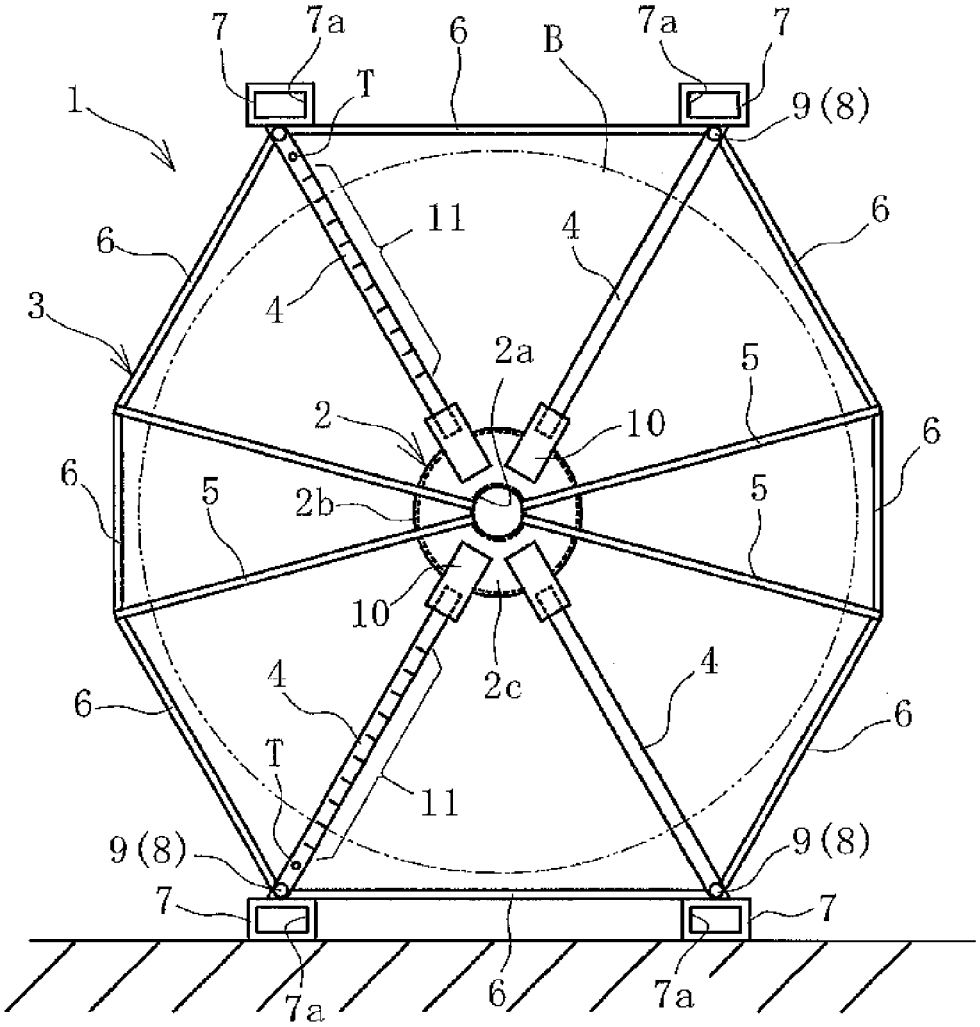
FIG. 1 is a front view of an example of a conveyor belt take-up drum according to the present technology.
Figure 2:
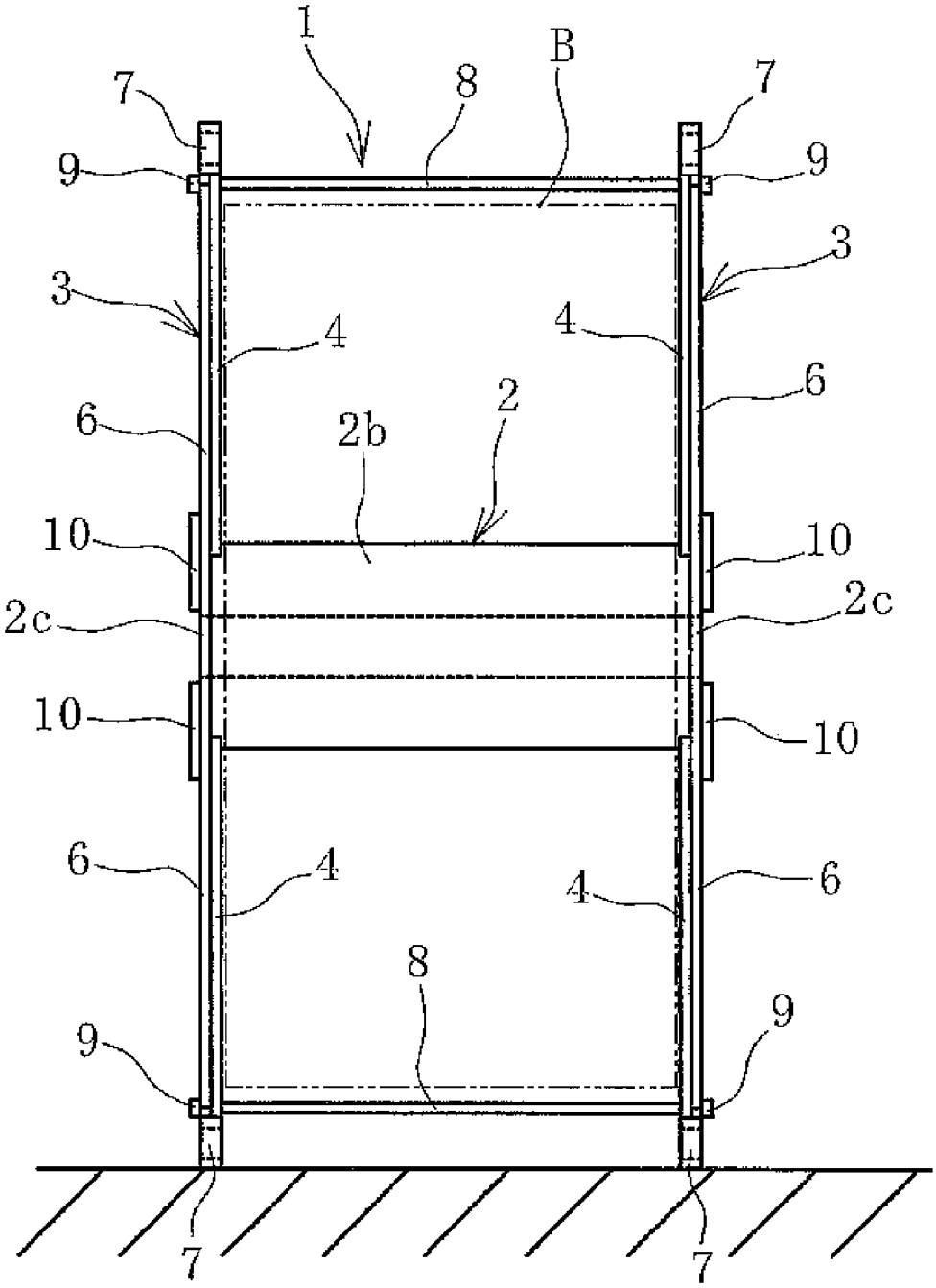
FIG. 2 is a side view of the take-up drum illustrated in FIG. 1.
Figure 3:
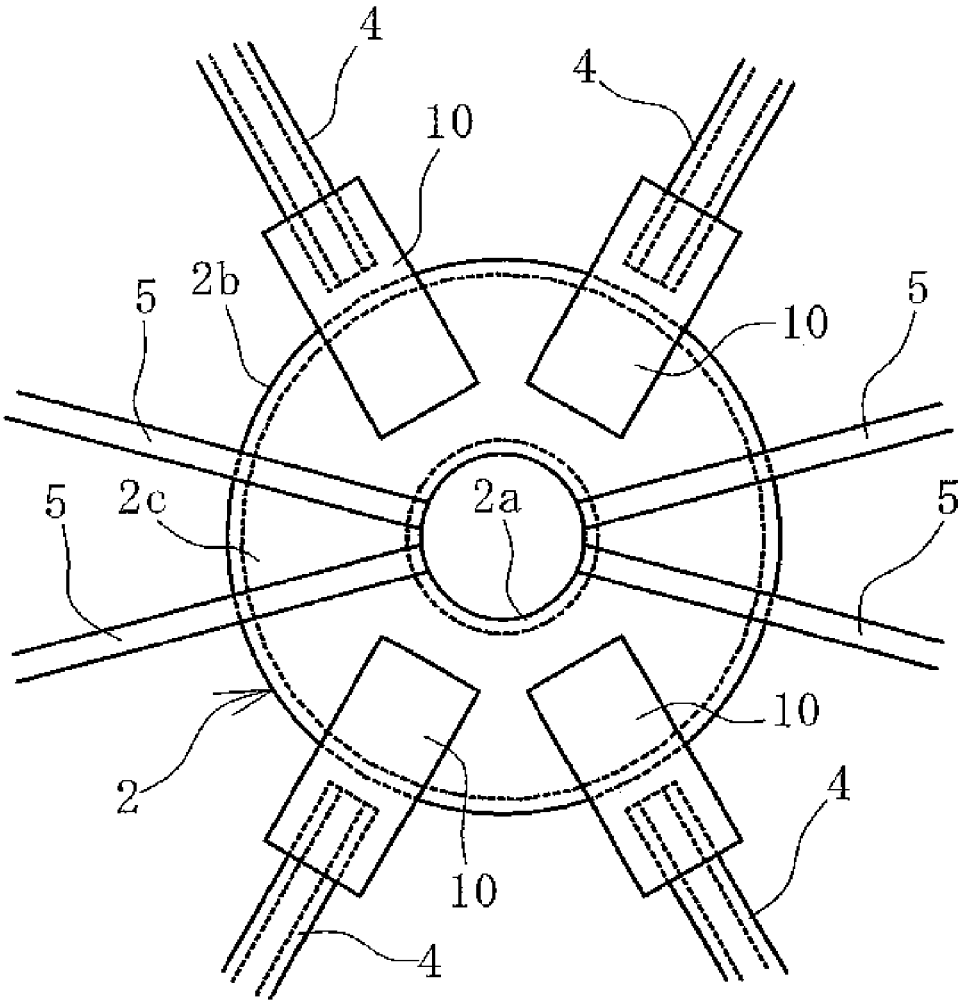
FIG. 3 is a magnified view of an example of the vicinity of a joint between a radial direction member and a core section.

As illustrated in FIGS. 1 to 3, a conveyor belt take-up drum 1 (hereinafter, referred to as take-up drum 1) according to the present technology is provided with a cylindrical core section 2 and flange sections 3 provided on both ends of the core section 2. The core section 2 is constituted by an inner cylinder 2*a*, an outer cylinder 2*b*, and cap plates 2*c* covering the ends in the axial direction of the cylinders.

Each of the opposing flange sections 3 is constituted by a plurality of main radial direction members 4 and supporting radial direction members 5 radially extending outward from the core section 2 in the radial direction, and circumferential direction members 6 linking the outer ends of the main radial direction members 4 and supporting radial direction members 5 to form a ring. The main radial direction members 4 are thicker and have greater bending rigidity than the supporting radial direction members 5. Ordinary structural steel is used for the main radial direction members 4 and the supporting radial direction members 5. In this embodiment, H-beams are used for the main radial direction members 4. Plate steel or the like is used for the core section 2.

The number of main radial direction members 4 is, for example, about 4 to 12. The supporting radial direction members 5 are provided as necessary, and may be present, for example, in a number roughly equal to that of the main radial direction members 4. In this embodiment, a single flange section 3 is provided with four main radial direction members 4 and supporting radial direction members 5 apiece, and the circumferential direction members 6 form a hexagonal ring shape. The circumferential direction members 6 are not limited to forming a hexagonal shape, and other polygonal ring shapes are possible according to the number of main radial direction members 4 and supporting radial direction members 5; alternatively, a ring shape is also possible.

The main radial direction members 4 and supporting radial direction members 5 of the respective flange sections 3 are disposed at opposing positions. Ground-contacting sections 7 are provided on a portion of the circumferential direction members 6. One pair of adjacent ground-contacting sections 7 is placed upon the ground so as to provide a stable rest for the take-up drum 1. In this embodiment, the ground-contacting sections 7 are provided around the outer ends of the respective main radial direction members 4. The ground-contacting sections 7 comprise insert holes 7*a* into which the tines of a forklift can be inserted.

Spacers 8 of substantially the same length as the width of a conveyor belt B being taken up on the core section 2 are detachably disposed between opposing outer ends of those main radial direction members 4 of the respective flange sections 3 that are linked to the circumferential direction members 6 provided with the ground-contacting sections 7. The spacers 8 are formed from steel or the like, and are detachably anchored to the outer ends of the main radial direction members 4 by anchoring bolts 9 or the like.

The bending rigidity near the joints between the core section 2 and the inner ends of the opposing main radial direction members 4 between which the spacers 8 are detachably provided is set lower than the bending rigidity of the main bodies of the main radial direction members 4 (i.e., those parts thereof not near the joints). That is, the area near the joints has a relatively flexible structure. In the present context, "bending rigidity" refers to the rigidity of the main radial direction members 4 when bent in the direction of the opposing main radial direction member 4.

In this embodiment, linking plates 10 are interposed between the inner ends of the main radial direction members 4 and the core section 2, and the bending rigidity of the linking plates 10 is set lower than the bending rigidity of the main bodies of the main radial direction members 4. By virtue of this structure, the bending rigidity near the joints is lower than the bending rigidity of the main bodies of the main radial direction members 4. The bending rigidity near the joints is, for example, from 10 to 50% lower than that of the main bodies of the main radial direction members 4.

In an example of a specific structure, steel plates that are thinner than the main radial direction members 4 are used for the linking plates 10. If the main radial direction members 4 and the linking plates 10 are of the same material, the linking plates 10 are imparted with a section modulus that is lower than that of the main radial direction members 4. The linking plates 10 are anchored to the core section 2 and the inner ends of the main radial direction members 4 via bolts, welding, or the like.

When the conveyor belt B is to be transported, a first end in the length direction of the conveyor belt B is anchored to the core section 2, and the take-up drum 1 is rotated to take up the conveyor belt B. After the conveyor belt B has been taken up, opposing outer ends of the main radial direction members 4 on the respective flange sections 3 are linked using the spacers 8, a portion having the flexible structure near the joints between the inner ends of the main radial direction members 4 and the core section 2 deforms to a comparatively large degree. The conveyor belt B taken up on the core section 2 is sandwiched between the main radial direction members 4, putting the main radial direction members 4, the spacers 8, and the conveyor belt B into an integrated state. As a result, clearance between the ends in the belt width direction of the conveyor belt B and the main radial direction members 4 can be eliminated or minimized. This suppresses shifting in the belt width direction of the taken-up conveyor belt B when being transported, allowing the stability of the take-up drum 1 to be further improved.

Suppressing shifting of the conveyor belt B in the belt width direction allows impacts upon the main radial direction members 4 to be eliminated or reduced. As a result, the load (stress) generated near the inner ends of the main radial direction members 4 is reduced, allowing the weight of the main radial direction members 4 and therefore the weight of the take-up drum 1 to be reduced. This allows the material costs of the take-up drum 1 and the transportation costs of the conveyor belt B to be reduced.

Figure 4:
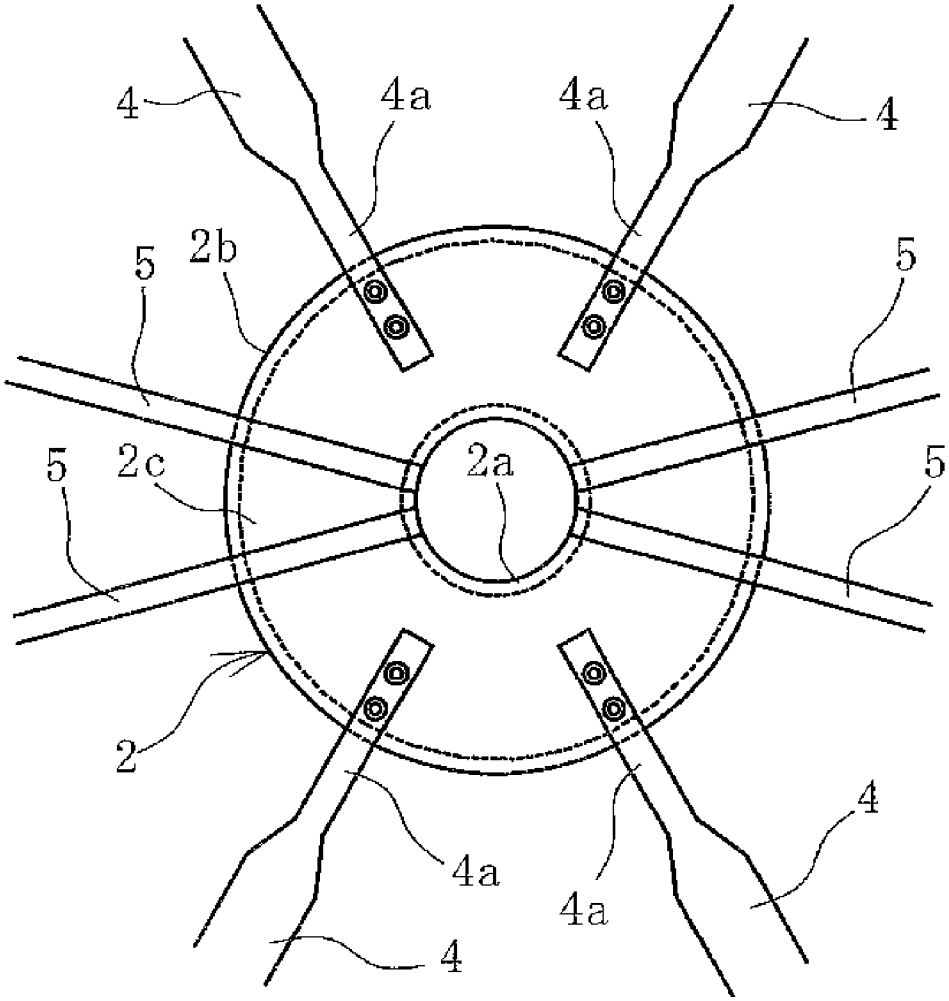
FIG. 4 is a magnified view of another example of the vicinity of a joint between a radial direction member and a core section.

As illustrated in FIG. 4, the areas near the inner ends of the main radial direction members 4 can be formed into thin sections 4*a* that have the same thickness but a narrower width than the main bodies of the main radial direction members 4. The inner ends (thin sections 4*a*) of the main radial direction members 4 are anchored to the core section 2 via bolts, welding, or the like. As a result, the bending rigidity near the joints between the core section 2 and the inner ends of the main radial direction members 4 can be set lower than the bending rigidity of the main bodies of the main radial direction members 4. A configuration in which the area near the inner ends of the main radial direction members 4 has the same width but a lower thickness than the main bodies of the main radial direction members 4 is also possible.

In this embodiment, the spacers 8 are detachably provided between the opposing outer ends of the main radial direction members 4 at symmetrical positions with respect to the core section 2, and the bending rigidity near the joints between the core section 2 and the inner ends of the main radial direction members 4 is set lower than the bending rigidity of the main bodies of the main radial direction members 4. Such a structure further improves the stability of the take-up drum 1 onto which the conveyor belt B has been taken up. In addition, the load (stress) generated near the inner ends of the upper main radial direction members 4 is reduced, allowing the weight of these main radial direction members 4 to be reduced.

Figure 5:
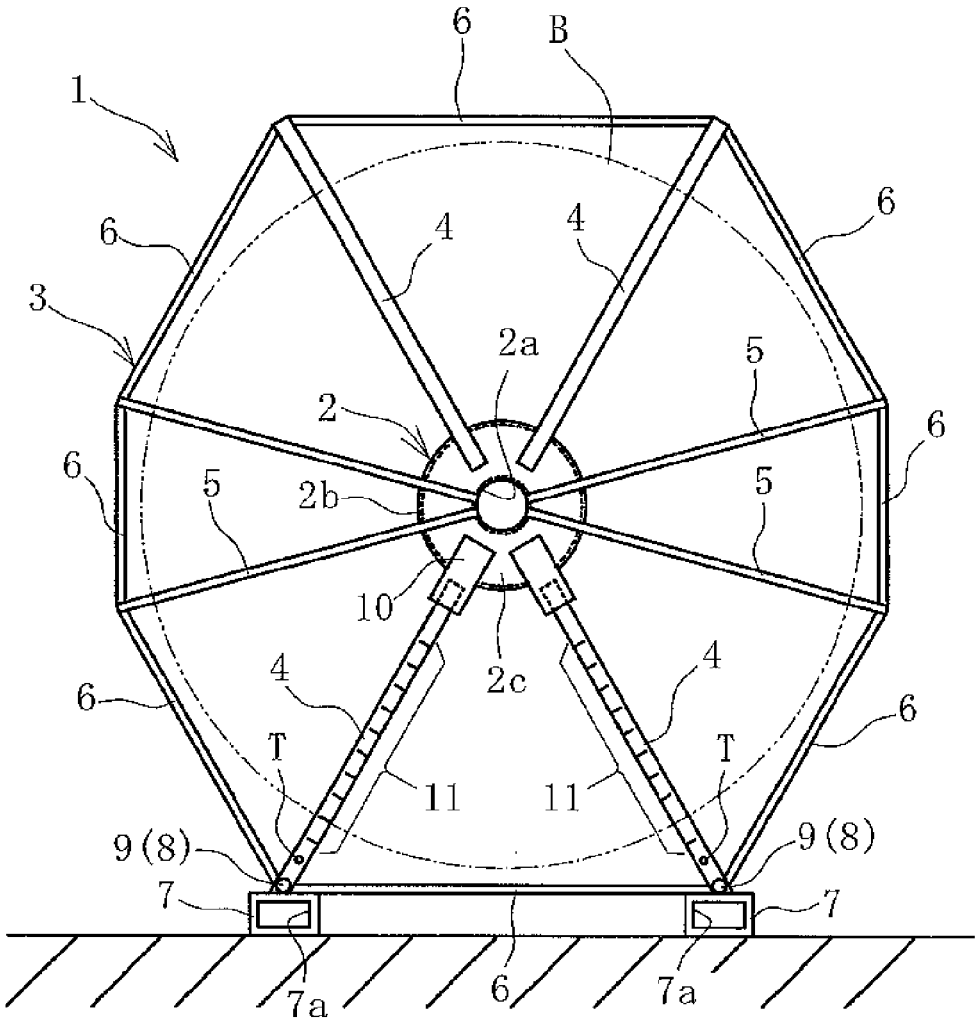
FIG. 5 is a front view of another embodiment of a take-up drum.

In the present technology, as in the embodiment illustrated in FIG. 5, a configuration in which the spacers 8 are only provided between the main radial direction members 4 on the lower side of the take-up drum 1, the bending rigidity near the joints between the inner ends thereof and the core section 2 is set comparatively low, and a flexible structure is formed near the joints is also possible.

In the embodiments illustrated in FIGS. 1 and 5, indicators (markings) 11 indicating the length of the taken up conveyor belt B at those positions are displayed at predetermined intervals on the outer surfaces of the main radial direction members 4. Providing these indicators 11 allows the length of the conveyor belt B taken up on the take-up drum 1 to be determined simply by looking at the indicator 11 at the position corresponding to the outermost circumference of the conveyor belt B. That is, the length of the remaining conveyor belt B on the take-up drum 1 can be determined instantaneously.

The size of the take-up drum 1 is generally roughly from 3.2 m to 3.6 m, equivalent to the outer diameter of the conveyor belt B when the conveyor belt B has been taken up to the maximum extent. Thus, concentrating the indicators 11 on the lower main radial direction members 4, as in the case of the embodiment illustrated in FIG. 5, makes the indicators 11 easier to read.

Because the positions of the indicators 11 will vary (differ) according to the thickness T of the conveyor belt B, the indicators 11 can be marked on the outer surfaces of the main radial direction members 4 along with the thickness T of the taken-up conveyor belt B. The indicators 11 and thickness T of the conveyor belt B may also be marked on the outer surfaces of the supporting radial direction members 5.

Figure 6:
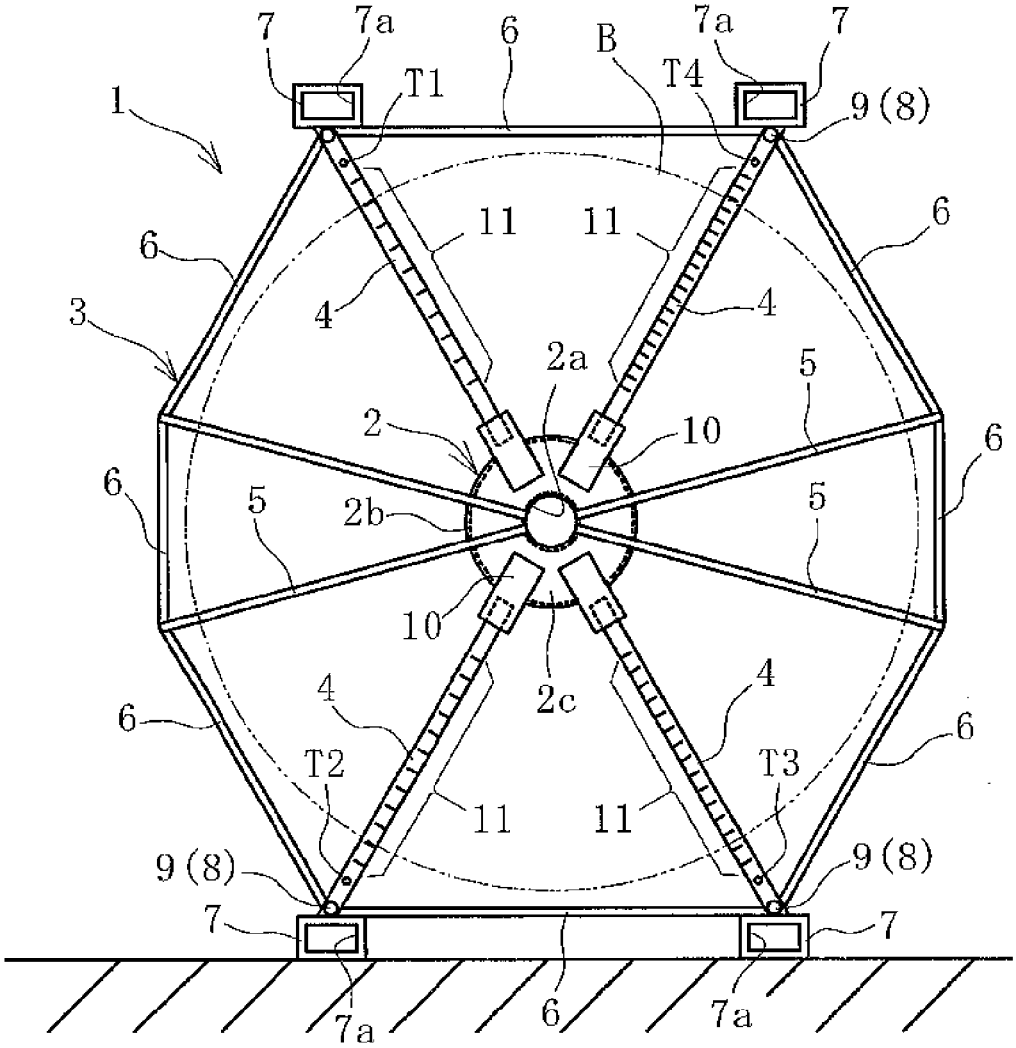
FIG. 6 is a front view of yet another embodiment of a take-up drum.

It is also possible for thicknesses T (T1, T2, T3, T4) of taken-up conveyor belt B to be marked along with indicators 11 on the outer surfaces of different main radial direction members 4 according to the thicknesses T (T1, T2, T3, T4), as in the embodiment illustrated in FIG. 6. In this embodiment, if the thickness T (T1, T2, T3, T4) of the conveyor belt B is known, one may look at the indicators 11 on the main radial direction member 4 bearing the marking for that thickness T (T1, T2, T3, T4) in order to determine the length of the conveyor belt B taken up on the take-up drum 1. The indicators 11 and thickness T of the conveyor belt B may also be marked on the outer surfaces of the supporting radial direction members 5.

What is claimed is:

1. A conveyor belt take-up drum, comprising:

a core section;

flange sections provided at both ends in the axial direction of the core section, each of the flange sections being constituted by a plurality of radial direction members radially extending outward from the core section in the radial direction and a circumferential direction member linking outer ends of the radial direction member to form a ring, the radial direction members of the respective flange sections being disposed at opposing positions, and ground-contacting sections being provided on a portion of the circumferential direction members; and spacers of substantially the same length as the width of the conveyor belt being taken up by the core section being detachably provided between opposing outer ends of the radial direction members linked to the circumferential direction members of the respective flange sections that are provided with ground-contacting sections, and the bending rigidity near joints between inner ends of the opposing radial direction members and the core section being set lower than the bending rigidity of main bodies of the radial direction members, the radial direction members having a smaller thickness or width near the joints than at the main bodies.

2. The conveyor belt take-up drum according to claim 1, wherein the spacers are detachably provided between opposing outer ends of the radial direction members located at symmetrical positions with respect to the core section, and the bending rigidity near joints between the core section and inner ends of the radial direction member is set lower than the bending rigidity of the main bodies of the radial direction members.

3. The conveyor belt take-up drum according to claim 2, wherein indicators indicating the length of the taken-up conveyor belt at that position are marked on outer surfaces of the radial direction members.

4. The conveyor belt take-up drum according to claim 3, wherein the indicators are marked on the outer surface of the radial direction members along with the thickness of the taken-up conveyor belt.

5. The conveyor belt take-up drum according to claim 4, wherein thicknesses of the taken-up conveyor belt are marked along with the indicators on the outer surfaces of different radial direction members according to the thicknesses of the taken-up conveyor belt.

6. The conveyor belt take-up drum according to claim 1, wherein linking plates that are interposed between the core section and the inner ends of the radial direction members and have a lower bending rigidity than the main bodies of the radial direction members constitute the area near the joints.

7. The conveyor belt take-up drum according to claim 6, wherein indicators indicating the length of the taken-up conveyor belt at that position are marked on outer surfaces of the radial direction members.

8. The conveyor belt take-up drum according to claim 7, wherein the indicators are marked on the outer surface of the radial direction members along with the thickness of the taken-up conveyor belt.

9. The conveyor belt take-up drum according to claim 8, wherein thicknesses of the taken-up conveyor belt are marked along with the indicators on the outer surfaces of different radial direction members according to the thicknesses of the taken-up conveyor belt.

10. The conveyor belt take-up drum according to claim 1, wherein indicators indicating the length of the taken-up conveyor belt at that position are marked on outer surfaces of the radial direction members.

11. The conveyor belt take-up drum according to claim 10, wherein the indicators are marked on the outer surface of the radial direction members along with the thickness of the taken-up conveyor belt.

12. The conveyor belt take-up drum according to claim 11, wherein thicknesses of the taken-up conveyor belt are marked along with the indicators on the outer surfaces of different radial direction members according to the thicknesses of the taken-up conveyor belt.

* * * * *